US005442871A

United States Patent [19]

Sarkisian et al.

[11] Patent Number: 5,442,871

[45] Date of Patent: Aug. 22, 1995

[54] POSTER AND SIGN DISPLAY ASSEMBLY

[75] Inventors: Robert Sarkisian, Southfield; David J. Muir, Farmington Hills; David U. Hillstrom, Novi, all of Mich.

[73] Assignee: Marketing Displays, Inc., Farmington Hills, Mich.

[21] Appl. No.: 76,004

[22] Filed: Jun. 11, 1993

[51] Int. Cl.[6] ..... G09F 1/12

[52] U.S. Cl. ..... 40/606; 40/611

[58] Field of Search ..... 40/606, 607, 608, 611, 40/612, 647, 156; 248/160, 900, 469, 473

[56] References Cited

U.S. PATENT DOCUMENTS

| | | | |
|---|---|---|---|
| 778,748 | 12/1904 | Howell | 40/611 |
| 1,127,223 | 2/1915 | Fogle | 40/606 |
| 2,979,842 | 4/1961 | DeRidder | 40/647 X |
| 3,310,901 | 3/1967 | Sarkisian . | |
| 3,646,696 | 3/1972 | Sarkisian . | |
| 3,662,482 | 5/1976 | Sarkisian . | |
| 4,033,536 | 7/1977 | Hillstrom . | |
| 4,145,828 | 3/1979 | Hillstrom | 40/156 |
| 4,288,053 | 9/1981 | Sarkisian . | |
| 4,519,152 | 5/1985 | Seely et al. | 40/156 |
| 4,548,379 | 10/1985 | Seely et al. . | |
| 4,569,499 | 2/1986 | Seely . | |
| 4,593,879 | 6/1986 | Seely et al. . | |
| 4,691,892 | 9/1987 | Grewe et al. . | |
| 4,937,959 | 7/1990 | Palmer et al. | 40/156 |
| 4,958,458 | 9/1990 | Hillstrom et al. | 40/156 |
| 4,986,013 | 1/1991 | Pollack | 40/611 X |

*Primary Examiner*—James R. Brittain
*Assistant Examiner*—Joanne Silbermann
*Attorney, Agent, or Firm*—Brooks & Kushman

[57] ABSTRACT

Free standing and wall mounted poster and sign displays are disclosed. Each of these devices comprise a sign frame with similar top and bottom curved extrusions, similar side frame extrusion members, and a backing member. The upper and lower frame extrusion members include elongated slots which are used to hold the display indicia in place by the "lift and fall" principle. The side frame members contain spring biased cover members which clamp the sign materials in place against the backing member. A clear protective covering member is hooked in place in the slot in the upper frame extrusion member. Unique corner connecting members are used to secure and connect together the frame members around the backing member forming the sign devices. The corner connecting members comprise cap members which cover the open ends of the upper and lower frame extrusion members, as well as insert members which fit within the open ends of the side frame extrusion members. The free standing sign frame also includes a base assembly comprising a pair of leg members and spring members. The sign frame is attached to the top of the spring members.

13 Claims, 6 Drawing Sheets

POSTER AND SIGN DISPLAY ASSEMBLY

TECHNICAL BACKGROUND

The present invention relates to free standing and wall mounted poster and sign displays.

BACKGROUND ART

There are many varieties and types of poster and sign display products in use today. These products include, for example, poster and picture frames that can be mounted on a vertical surface, such as the interior or exterior walls of a building, free standing devices which have one or more mechanisms for holding and displaying a poster or sign, frames connected to poles or other structures which hold and display a poster or sign, and sign stands which display posters and signs and are also "wind resistant".

One example of a frame mechanism which is used to hold and display posters and other display indicia either inside or outside a facility are the PosterGrip products marketed by Marketing Displays International, Farmington Hills, Mich. One type of sign stand which is wind resistant, is the WindMaster product also marketed by Marketing Displays International. The WindMaster product has an upright sign frame supported by a pair of coil springs which are attached to ground engaging leg members. The sign frame typically has four frame sections around its perimeter in order to hold a poster or sign display. The coil springs allow the sign stand to bend in the wind when it is exposed to significant wind forces and thus allows the sign stand to remain in place regardless of the wind and environmental conditions.

A number of the various types of known poster frames and sign stands, such as the PosterGrip and WindMaster products, have had significant commercial success and have been well received in the marketplace. These products are aesthetically pleasing, hold and protect the poster and sign material adequately in all kinds of environmental conditions, are durable and long lasting, are economical to manufacture and assemble, and are easy to store and transport to different locations.

It is an object of the present invention to provide a wall mounted poster and sign display, as well as a free standing spring-mounted poster and sign display which are aesthetically pleasing, economical, easy to assemble and fabricate, are protective of the poster and sign displays in various wind and environmental conditions, and are also durable and functional regardless of the placement and environmental conditions.

It is also an object of the present invention to provide a wall mounted poster and sign display which has curved single piece extrusions across the top and bottom edges and which hold the sign indicia in them by the "lift and fall" principle, and which holds and retains the sign indicia firmly in place by biased frame sections only along the two side edges. It is a further object of the present invention to provide a wall mounted poster and sign display which has a clear protective member over the sign indicia in order to better protect it from the environmental conditions. It is a still further object of the invention to provide a wall mounted frame and poster display which better protects the poster and sign indicia from various environmental elements, such as rain, snow and other wet and humid conditions. It is another object of the present invention to provide a wall mounted poster and sign display which has improved corner connecting members securely connecting the frame sections together.

As to free standing poster and sign displays, it is an object of the present invention to provide such displays which better protect the poster and sign indicia from environmental conditions, such as wind and rain. It is another object of the present invention to provide a free standing poster and sign display which has curved one-piece extrusions on the upper and lower edges and is adapted to firmly retain and utilize clear protective cover sheets for the sign indicia.

It is still another object of the present invention to provide a free standing poster and sign display which is "wind resistant" and in which the legs and spring biasing members are connected to the sign display in an improved and easier to assemble manner.

It is another object of the present invention to provide a free standing poster and sign display which utilizes unique corner connecting members to hold the frame sections together and allow simple and easy fabrication and assembly. Still other objects, features, benefits and advantages of the present invention will become apparent when the following description and drawings are viewed in accordance with the appended claims.

DISCLOSURE OF INVENTION

The present invention comprises unique and beneficial free standing poster and sign displays and wall mounted poster and sign displays. The free standing sign display comprises a pair of ground engaging leg members attached to a pair of coil springs which allow the sign frame to bend in strong wind conditions. The sign frame is two sided, that is it is adapted to allow the presentation and viewing of display indicia on each of its two sides. Curved extrusion members are positioned on the top and bottom edges of the sign frame and a pair of identical extrusion members are positioned along the side edges. The four frame sections are connected together by unique corner connecting members which allow simple and easy fabrication and assembly of the sign display.

The leg members are attached to the bottom of the coil springs and the coil springs in turn are attached to the lower curved extrusion member of the sign frame. A backing member is positioned in the sign frame secured by the top and bottom extrusions and the two side clamping members. Each of the side members comprise a spring biased cover member which securely holds the sign indicia in place against the backing panel. The sign indicia are held in the top and bottom curved extrusion members by the "lift and fall" principle. Since the sign indicia is simply inserted into position in the top and bottom extrusion members and only clamped in place along its sides, the present inventive sign frame is easier to load and unload than sign frames which have clamping members on all four sides, and also is more convenient to use if positioned on a wall or shelf high off the ground.

The curved extrusion members retain clear protective sheets on each side of the sign frame which help protect the poster and sign indicia from rain, snow and other adverse environmental conditions. The top extrusion is one piece and does not allow moisture or other adverse environmental conditions to contact the top edge of the poster and sign indicia. The bottom extrusion member has a plurality of drain holes, as well as stop members which keep the backing member, clear protective member and sign indicia raised above the bottom of the extrusion to avoid wicking.

The clear protective member has a "hooked" upper end. After the protective sheet is placed into the slot in the upper extrusion member, the "hook" retains the sheet in place. The top extension member has a ridge adjacent a slotted opening which holds the hooked end in position.

The sign frame is assembled by means of corner connecting members, each of which comprises a molded cap member and an elongated insert member. The cap member fits within the ends of the curved extrusion members while the insert member fits within the side extrusion members. The insert members are secured to the side extrusion members by staking or riveting. Several of the parts are identical or common for ease of manufacturing and assembly.

Similarly, the wall mounted poster and sign display comprises top and bottom curved extrusion members, a backing member, a pair of side spring biased clamping extrusion members, and corner connecting members holding the four frame sections in place. The two curved extrusions and two side extrusions are positioned around the backing panel. The side frame extrusions have spring biased cover members which are used to securely hold and retain the poster and sign indicia against the backing panel. The sign indicia is positioned in grooves in the upper top and bottom curved extrusion members by the "lift and fall" principle. The top and bottom curved extrusion members also have a ridge adjacent the slotted opening in order to position and retain a clear protective sheet in the frame. The corner connecting members are attached to the top and bottom curved extrusions and the side extrusions by pop rivets or the like.

Other aspects, components and embodiments of the present invention are shown in the drawings and described in the following specification and claims.

BEST MODE(S) FOR CARRYING OUT THE INVENTION

Figure 1:
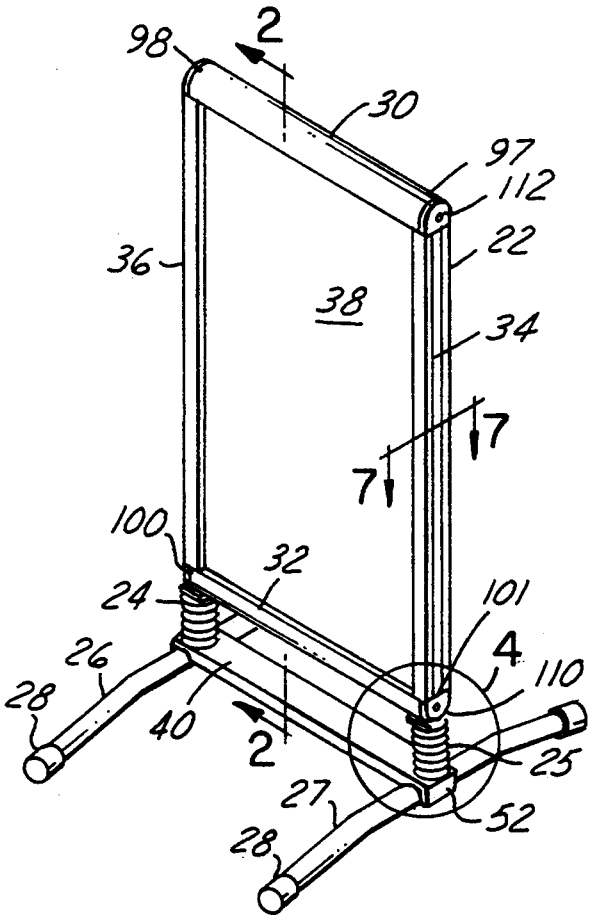
FIG. 1 illustrates a free standing sign and poster display in accordance with the present invention.

FIGS. 1–10 illustrate the preferred and alternate embodiments of the free-standing poster and sign display in accordance with the present invention. The device is indicated by the reference numeral 20. FIGS. 11–15 illustrate the wall mounted embodiment of the invention, which is referred to generally by the reference numeral 200.

As shown in FIGS. 1–10, the free-standing device 20 includes an upstanding sign frame 22, a pair of coil springs 24 and 25 and a pair of ground engaging leg members 26 and 27. The sign frame comprises a curved upper extrusion member 30 and a curved lower extrusion member 32, a first side extrusion member 34 and a second side extrusion member 36. The four frame members 30, 32, 34 and 36 surround and hold in place a backing member 38. As is apparent from FIGS. 2, 3, 5 and 7, the sign frame 22 allows the display and presentation of poster and other display indicia on each of the two planar sides of the sign panel 38.

For purposes of the present description, the materials which can be positioned and displayed in the present invention, will be referred to severally by the terms "display indicia" or "sign materials". These terms are not meant to be limiting, however, and are intended to refer to and include every type of signage, posters, display materials, advertisements, photographs, and the like which may be displayed by the owner or user of a sign stand or sign frame.

As shown in the drawings, a pair of ground engaging members 26 and 27 are provided, and each member comprises a single hollow aluminum or metal tubular member. It is understood, of course, that more than two ground engaging members could be provided and that each member could be comprised of two or more parts. Also, it is possible to include end or cap members 28 on the ends of the legs 26 and 27 if desired (as shown in phantom lines in FIG. 1). The legs 26 and 27 are connected by a cross brace 40. The cross brace is formed of a metal material, such as aluminum, and is bent and provided in the shape shown in the drawings. The cross brace 40 is connected to the legs 26, 27 by bolts 42 or other conventional fasteners and the leg and cross brace in turn are connected to springs 24 and 25 by similar bolts 42 or fasteners.

Figure 5:
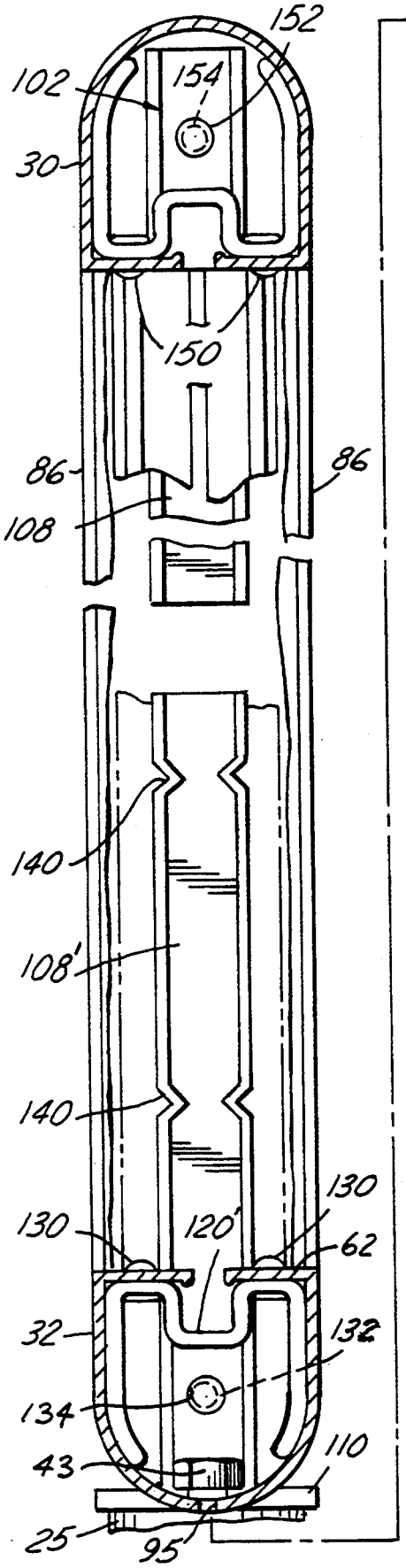
FIG. 5 is another cross sectional view of the present invention showing the manner in which the coil springs are attached to the sign frame and leg members and also showing the use of the corner connecting members.
Figure 5:
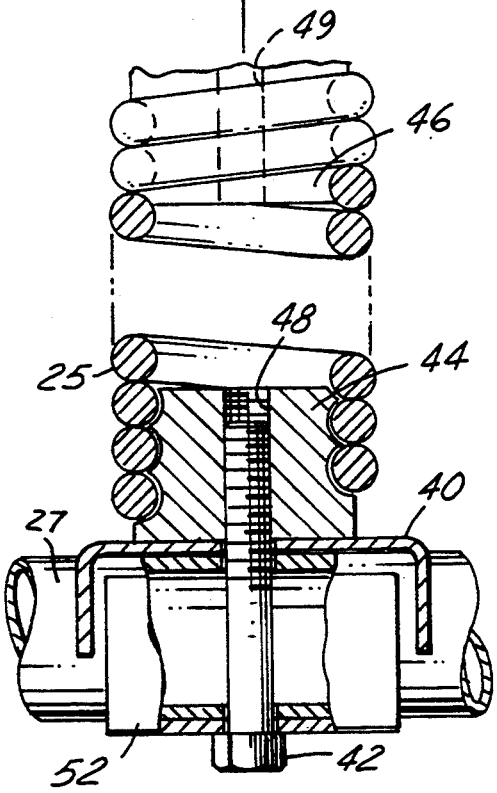

A pair of core plug members 44 and 46 are positioned in each of the coil springs 24 and 25 and used to connect the springs to the legs and to the sign frame. The plug members 44 and 46 are preferably metal cast plugs and are screwed into the ends of the coil springs 44 and 46, as shown in FIG. 5. Bolt 42 which connects legs 26 and 27 to coil springs 24 and 25 is tightly secured into threaded opening 48 in the plug members 44 and 46. A fastener or bolt 43 which is similar to bolt 42 is utilized to connect the sign frame 22 to the plug member 46 and the upper end of the coil springs 24 and 25.

In order to more securely retain the ground engaging leg members 26 and 27 to the ends of the cross brace 40 and the bottom of the coil springs 24 and 25, it is also possible to provide a retaining bracket 52. The retaining bracket 52 is positioned around the middle of the legs and is held in place by bolts 42. It is understood, however, that it is not necessary to provide the retaining bracket 52 in all instances.

The plug members 44 and 46 are preferably cast from a metal material. The coil springs themselves are preferably of a type and size as illustrated and described in U.S. Pat. Nos. 3,646,696 and 3,662,482.

The top and bottom edge members 30 and 32 for the sign frame 22 have identical cross sections. They are preferably extruded of a metal material, such as aluminum. Each of the members 30 and 32 have curved outer surfaces 55 and 56 and parallel side walls 57, 58 and 59, 60, respectively. The remaining sides 61 and 62 of the extrusion members 30 and 32, respectively, have elongated slots 64 and 65 along their entire length.

Figure 3:
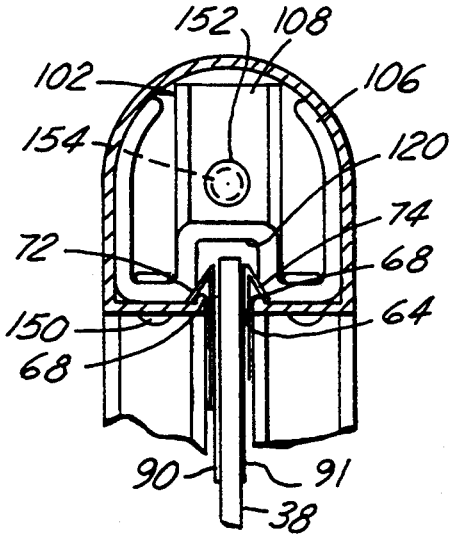
FIG. 3 is a partial cross sectional view of the upper extrusion member depicting the manner in which the sign panel and protective sheets are retained in the frame.

As shown in the drawings, the extrusion members 30 and 32 are oriented on the sign frame 22 such that the slots 64 and 65 face inwardly toward the backing panel 38. When the backing panel 38 is placed in the sign frame, the panel 38 protrudes into slots 64 and 65, such as shown in FIG. 3. In this manner, the backing member 38 is held securely in place in the sign frame along its top and bottom edges.

Ridges 68 and 70 are formed along the sides of the slots 64 and 65 in the extrusion members 30 and 32. The ridges protrude into the interior of the extrusion members 30 and 32 and are used to retain clear protective sheet members 72 and 74 in place, as shown in FIG. 3 and as described below. (It is also possible for a groove or other structure to be provided in place of the ridges, so long as it acts to hold the bent-over upper ends of the protective sheet members in place.)

The side frame members 34 and 36 are also identical extrusions made from a metal material, such as aluminum. For ease of illustration purposes, the description relative to side frame extrusion member 34, which is shown in detail in FIGS. 6 and 7, applies equally to side frame extrusion member 36.

Figure 7:
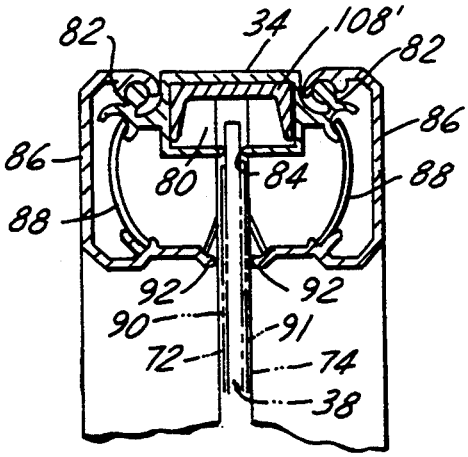
FIG. 7 is a cross-sectional view of the side frame members taken along line 7—7 and in the direction of the arrows in FIG. 1.
Figure 9:
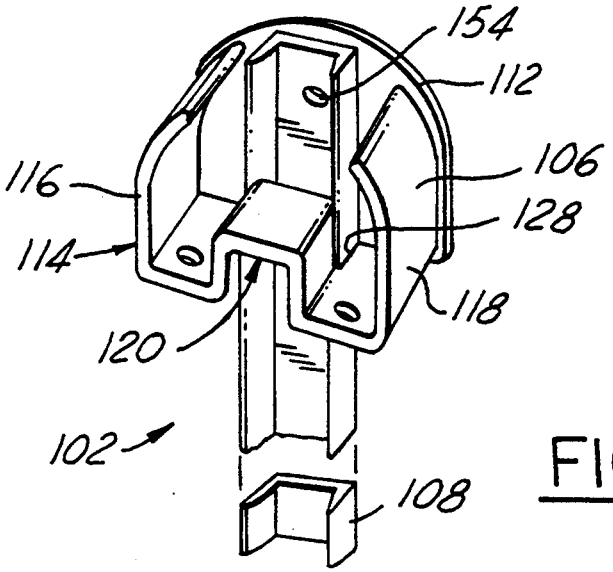
FIGS. 9 and 10 illustrate the upper and lower corner connecting members, respectively.
Figure 10:
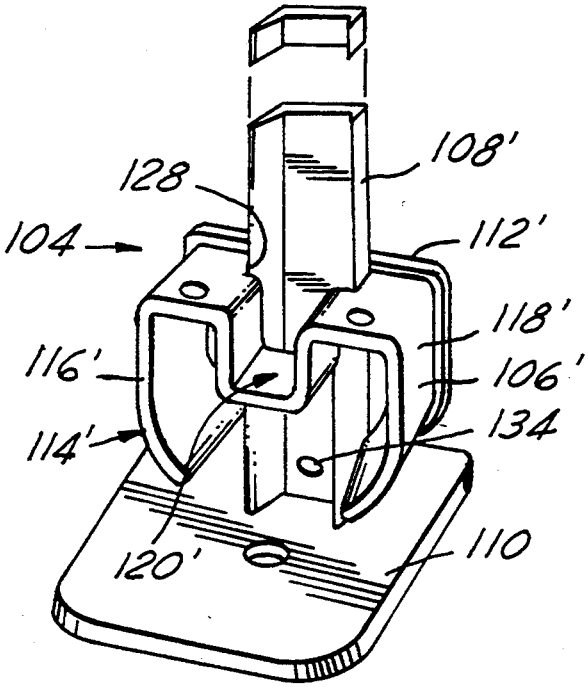

The side member 34 is provided in the cross-sectional size and shape shown in FIG. 7. A box-like walled channel 80 is formed in the center of the extrusion. The member 34 has a pair of outwardly extending hinge formation members 82 (one on each side). The member 34 also has a slot 84 along its length which is used for holding the side edges of the backing panel 38.

Attached to each of the hinge formation members 82 are spring biased cover members 86. The cover members 86 are also formed from an extruded metal material, such as aluminum, in the size and shape shown in the drawings.

The cover members 86 and the hinge members 82 are assembled together in the manner shown and a short leaf spring 88 is positioned between them. In use, the cover members 86 can be rotated manually to an open position to allow placement of the sign indicia 90 and 91 against the sign panel backing member 38 and then rotated to a closed position (as shown in FIG. 7) where the ends 92 of the cover members 86 contact and retain the sign materials 90, 91 in place in the sign frame along their side edges.

Further structure, operation and use of biased clamping mechanisms of this type for poster and sign frames are shown in U.S. Pat. No. 4,145,828 which is owned by the same entity as the present invention. The disclosure of the 4,145,828 patent is hereby incorporated by reference.

A plurality of small holes 95 are provided in the curved section 56 of the lower edge member 32. These holes are used as drainage holes in the event that any water or moisture collects in the member 32 during use of the inventive sign device 20.

The sign frame members 30, 32, 34 and 36 are held together in a rectangular relationship around the backing member by four corner connecting members. The two corner connecting members in the upper corners 97 and 98 of the sign frame 22 are the same (see FIG. 9) and are referred to generally by the reference numeral 102. Similarly, the two corner connecting members in the lower corners 100 and 101 of the sign frame 22 are the same (see FIG. 10) and are referred to generally by the reference numeral 104.

The corner connecting member 102 is comprised of a molded cap member 106 and an elongated pin or insert member 108. The lower corner connecting member 104 is comprised of a molded cap member 106' and an elongated insert member 108', as well as a base plate 110. Cap members 106 and 106' are the same and also insert members 108 and 108' are the same.

The cap members are provided to fit within and cover the open ends of the upper and lower extrusion members 30 and 32. The cap members 106, 106' are injection molded in the shape and configuration shown in the drawings and are preferably made from a plastic material such as polycarbonate, or a fiber or glass-filled nylon. The cap members may also be made from a zinc or aluminum die cast material if desired.

The cap members 106, 106' have outer end cap portions 112, 112' and U-shaped insert portions 114, 114' which fit within the ends of the top and bottom edge members 30 and 32. The insert portions 114, 114' have side wall members 116, 116' and 118, 118' which fit within and mate with the side wall members 57, 58 and 59, 60 of the upper and lower edge members 30 and 32, respectively. The insert portions also have channels 120, 120' which correspond to the elongated slots 64 and 65 in the edge members 30 and 32. The channels 120, 120' allow the backing member and sign indicia to fit within the top and bottom edge members 30, 32 and also act as stops to prevent the insert materials from being inserted too far into the interior of the edge members 30 and 32. As to lower edge member 32, the channel 120' also acts as a stop to prevent the backing member, display indicia and plastic covering members from contacting any water or moisture which may be trapped in the bottom of the member 32. This prevents "wicking" of the water by these elements from the bottom of member 32 where it might adversely affect the sign materials.

Figure 6:
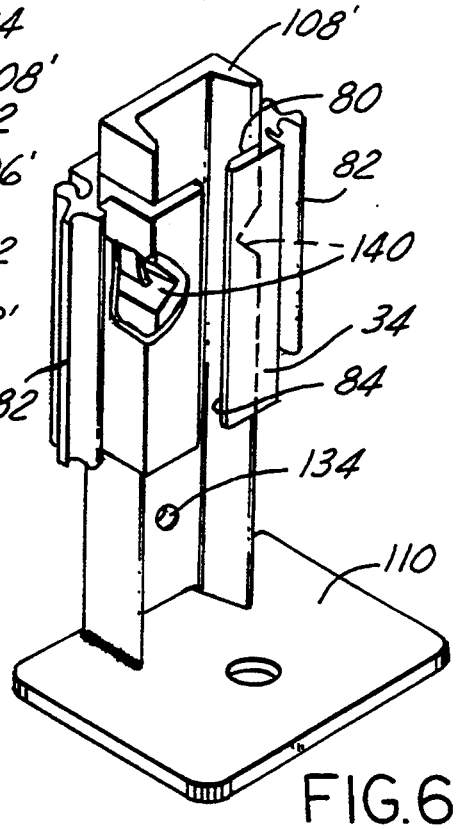
FIG. 6 illustrates the manner in which the corner connecting members are secured to the side frame members by swaging.

The insert members 108 and 108' are elongated pieces of metal channel material and are sized to fit firmly within the channels 80 in the side frame extrusion members 34 and 36. (This is shown in FIGS. 6 and 7.) The insert members 108' used for the lower corners 100 and 101 also include bottom plates 110. The plates 110 are used to connect the sign frame 22 to the coil springs 24 and 25. The plates 110 are attached to the insert members 108' in any conventional manner, such as by welding. The plates 110 are made from a metal material, such as steel, and preferably are made from the same material as the insert members 108 and 108'.

Figure 4:
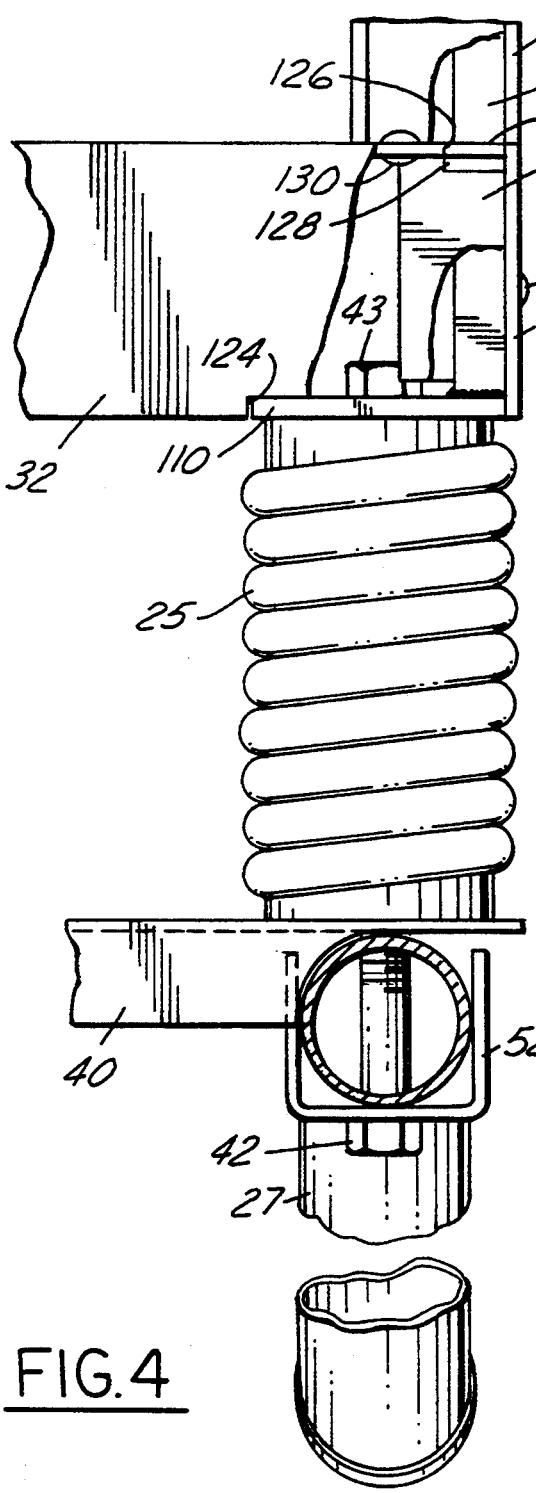
FIG. 4 is a partial cross sectional view depicting the manner in which the coil springs are connected to the sign frame and the ground engaging leg members.

When the sign device 20 is assembled, the leg members 26, 27, cross brace 40 and springs 24 and 25 are first assembled together as a unit. Insert members 108' with base plates 110 attached, are then secured to the upper ends of the springs 24 and 25 by bolts 43. Cap members 106' are then inserted into the two ends of the lower edge member 32. The member 32 is then inserted over the two upwardly standing insert members 108' on the base assembly. For this purpose, notches 124 are provided adjacent the two ends of the curved surface 56 of the extrusion member 32, as shown in FIG. 4. Also, notches 126 are provided adjacent the two ends of the surface 62 of the edge member 32 so that the insert members 108' can protrude upwardly through member 32 and be ready for assembly with the side frame extrusion members. The cap members 106' also include openings 128 for the same purpose.

Two cap members 106' are secured to the two opposite ends of the lower edge member 32 by a pair of fasteners 130, such a pop rivets.

When the lower edge member 32 is assembled to the base assembly over the upwardly extending insert members 108', a fastener, such as a pop rivet 132, is used to fasten the insert members 108' to the cap members 106'. An opening 134 is provided in the insert member 108' for that purpose.

After the lower edge member 32 is securely attached to the base assembly, the two side frame members 34 and 36 are assembled. The elongated members 34 and 36 with cover members 86 thereon are slid along the upstanding insert members 108' until the ends of the edge members 34, 36 mate with and abut the surface 62 of the lower edge member 32. The side frame edge members 34 and 36 are then secured to the insert members 108' by swaging or staking. Preferably one or more notches 140 are provided in the sides of the insert member 108', as shown in FIGS. 5 and 6, and the material of the side member 34 is deformed into the notches which then holds the parts 34 and 108' securely together.

With the present invention, the side frame extrusion members are formed with "square" (i.e. 90°) cut-off ends. This eliminates an additional step and the formation of waste material as opposed to the use of four frame members which have to be mitre cut at 45° to form a rectangular sign frame.

Figure 8:
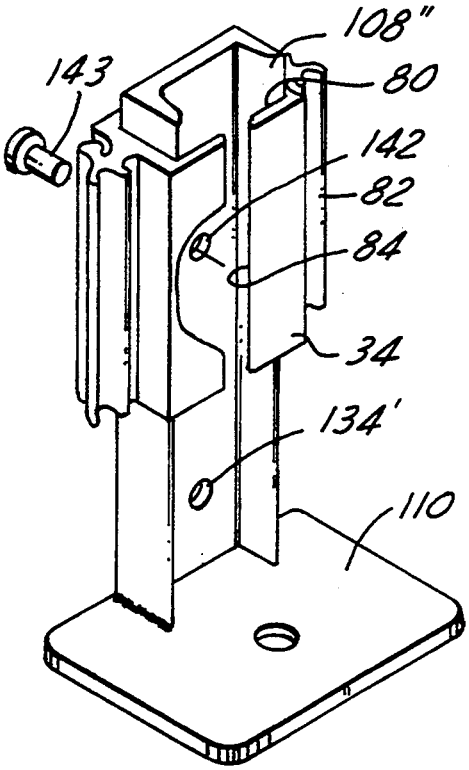
FIG. 8 illustrates an alternate embodiment for securing the corner connecting members to the side frame members.

An alternate embodiment for securing the edge members 34, 36 to the insert members is shown in FIG. 8. In this embodiment, the insert member is designated by the reference numeral 108" and contains one or more holes or openings 142. Side members 34 and 36 are secured to the upwardly extending insert member 108" by fasteners 143, such as pop rivets or the like, which are inserted through the outside of the surface of the side frame member into the opening 142.

In order to minimize unauthorized opening of the side cover members 86 and unauthorized tampering with or removal of the sign materials, it is also possible for the side extrusion members to be provided with a "tamper-proof" configuration, as shown in U.S. Pat. No. 4,519,152, the disclosure of which is hereby incorporated by reference.

Figure 2:
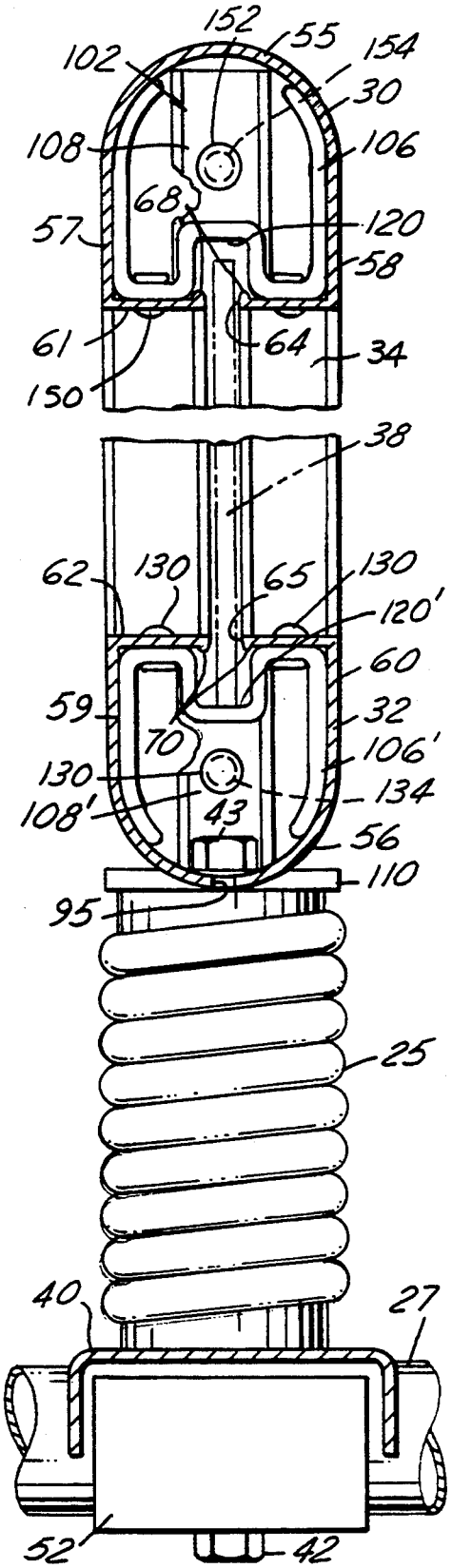
FIG. 2 is a cross section of the invention shown in FIG. 1, the cross section taken along line 2—2 and in the direction of the arrows shown in FIG. 1.

After the lower edge member 32 and side frame members 34 and 36 are assembled together, the backing member 38 is slid in place. The backing member is inserted downwardly through the slots 84 in the two side wall members (FIG. 7) and rests in the slot 65 in the lower edge member 32 (FIG. 2). If the backing member 38 is made from a stiff hard material on the order of $\frac{1}{8}''$–$\frac{1}{4}''$ thick, then nothing further needs to be done to hold the sign panel in place. However, if the backing member is made from a sheet of thin metal material, such as aluminum, then the side edges of the aluminum panel are preferably bent more than 90° relative to the plane of the backing member such that the bent ends fit down within channel 80 in the side members 34, 36 and are physically held in place in that manner.

In order to assemble the upper edge member 30 to the sign frame, the corner connecting members 102 are first inserted into the two open ends of member 30 and fastened in place. The cap members 106 are secured to the edge member 30 by a pair of fasteners, such as pop rivets 150. The insert portion 108 is then positioned in the cap members 106 and the member 108 is secured to the cap member 106 by a fastener member, such as a pop rivet 152. For this purpose, holes or openings 154 are provided in the upper ends of the insert members 108 (see FIGS. 2, 3 and 5).

After the corner connecting members 102 are secured to the ends of the upper edge member 30, the downwardly extending insert members 108 are inserted into the channels 80 in the side frame members 34 and 36. The upper edge of the backing member 38 is positioned in slot 64 and channel 120, as shown in FIG. 3, and the upper edge of the backing member is thus held securely in place. The side frame members 34 and 36 are then secured to the insert members 108 in the same manner as described above with reference to insert member 108', namely by swaging or fasteners such as pop rivets. Notches or holes in the insert member 108 are provided for this purpose.

In order to protect the sign materials 90, 91 which are placed on one or both sides of the sign frame 22, clear protective sheets of material, such as plastic overlay members 72 and 74, are provided, one on each side of the backing member 38 (see FIG. 3). The top edges of the covering members 72 and 74 are bent over more than 90° to form an acute angle, as shown in FIG. 3. The acutely bent upper edges are inserted into the slot 64 in the upper edge member 30 and the bent edges spring outwardly and hold the protective members 72 and 74 in place. The ridges 68 that are provided along the edges of the slot 64 catch and hold the bent ends of the materials 72 and 74 in place. The lower edges of the covering materials 72 and 74 are simply inserted into the slot 65 in the lower edge member 32 and held in place in that manner. The sides of the plastic overlay are held in place by the spring biased cover members 86 on the side frame members 34, 36. If desired, grooves or other members can be provided along the edges of the slots in place of the ridges, so long as they fulfill the purpose of helping to hold the bent upper edges of the covering materials in place in the upper extrusion member.

The covering materials 72, 74 prevent water, moisture and other elements from striking the sign materials and adversely affecting them. Securing the covering materials along all four edges prevents water and moisture from getting behind them and adversely affecting the sign materials.

In order to position a poster or sign indicia in the display device 20, the cover members 86 are opened on each of the two side edges of the backing member 38. The plastic cover members 72 and/or 74 are then rotated or raised sufficiently to allow the sign materials 90 and/or 91 to be inserted underneath (see FIG. 3). The upper edges of the sign materials 90, 91 are forced upwardly into the slot 64 and the lower edges are allowed to "fall" into the slot 65 in the lower edge member 32, thus holding the sign materials in place in the two members 30 and 32. The covering members 72, 74 are then positioned over the display indicia and the side frame cover members 86 are rotated to their closed positions to securely hold the side edges of both the sign indicia and covering members in place. The same procedure is followed on both sides of the sign frame 22 in order to insert and remove display indicia on the two sides.

With the present invention, it is only necessary to physically clamp in place two of the four edges of the sign materials and yet have the sign materials be firmly held in position. This provides ease of removal and insertion over sign frames which require the sign materials to be clamped along all four edges. Also, where the sign frame is placed at an elevated position, the present invention allows easier insertion and removal of the sign materials, and also eliminates the need for a ladder to reach the upper edge extension.

With the embodiment of the present invention as described above, an aesthetically pleasing sign stand device 20 is provided. The one-piece curved upper edges of the sign frame 22 not only provide a pleasing appearance but also prevent rain and moisture from contacting and adversely affecting the top edges of the display indicia positioned in the sign device. The clear plastic covering members 72 and 74 also protect the display indicia from water and other environmental conditions. Any water or moisture which strikes the plastic covers is directed into the gaps 65 in the lower edge member 32, exits through the holes 95 in the bottom of the member 32 and is thus removed from the sign device in that manner.

The sign frame 22 also has a plurality of the same or similar parts which provides significant savings in the cost of materials and assembly time. The ease of assembly of the sign frame, as described above, has significant economic and manufacturing advantages. The limited number of external fasteners, that is fasteners which are present on the external surfaces of the sign frame and thus are visible to customers and passersby, is also a benefit as it increases the aesthetic value of the product and also minimizes the possibility of tampering.

The coil springs 24 and 25, in combination with the legs 26 and 27, allow the sign device 20 to remain in place regardless of wind conditions. This is described and explained in more detail in U.S. Pat. Nos. 3,646,696 and 3,662,482, the disclosures of which are incorporated herein by reference.

FIGS. 11–15 illustrate the wall mounted embodiment of the invention. This embodiment is referred to generally by the reference numeral 200.

Figure 11:
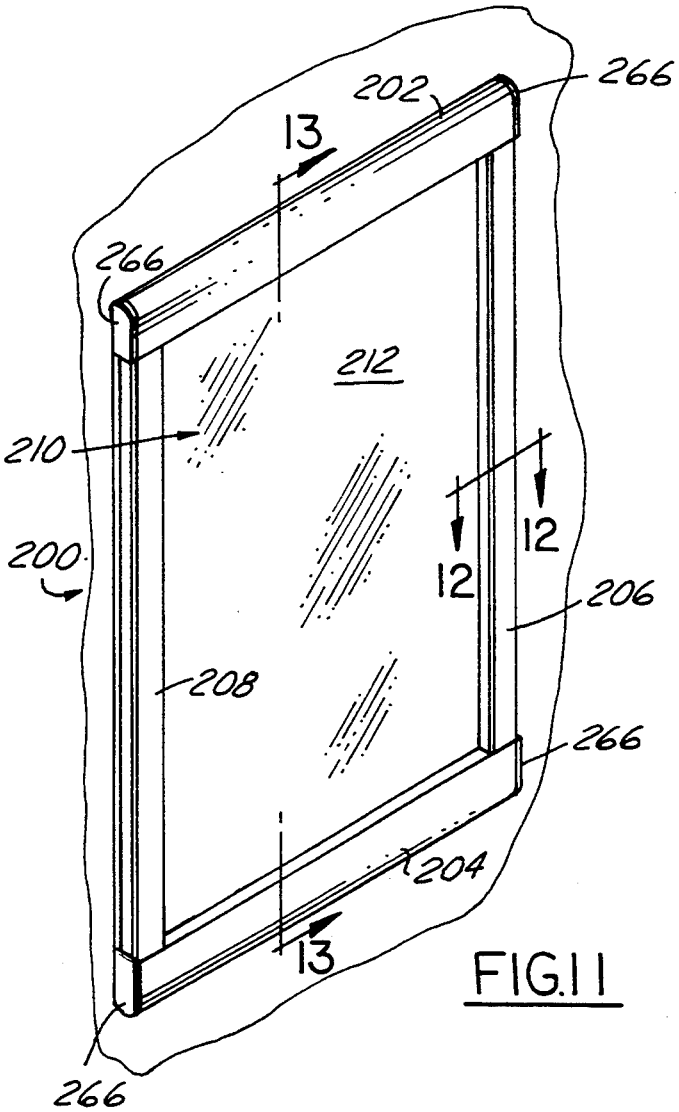
FIG. 11 illustrates the wall mounted embodiment of the present invention.
Figure 12:
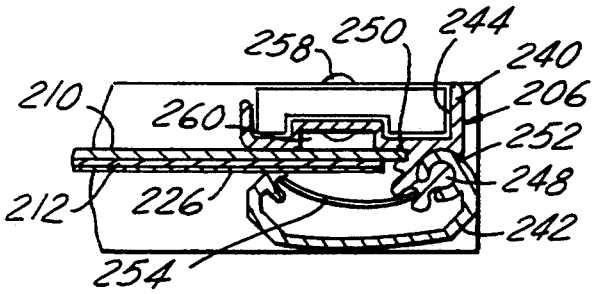
FIG. 12 is a cross-sectional view of the side frame member taken along line 10—10 in FIG. 9 and in the direction of the arrows.
Figure 13:
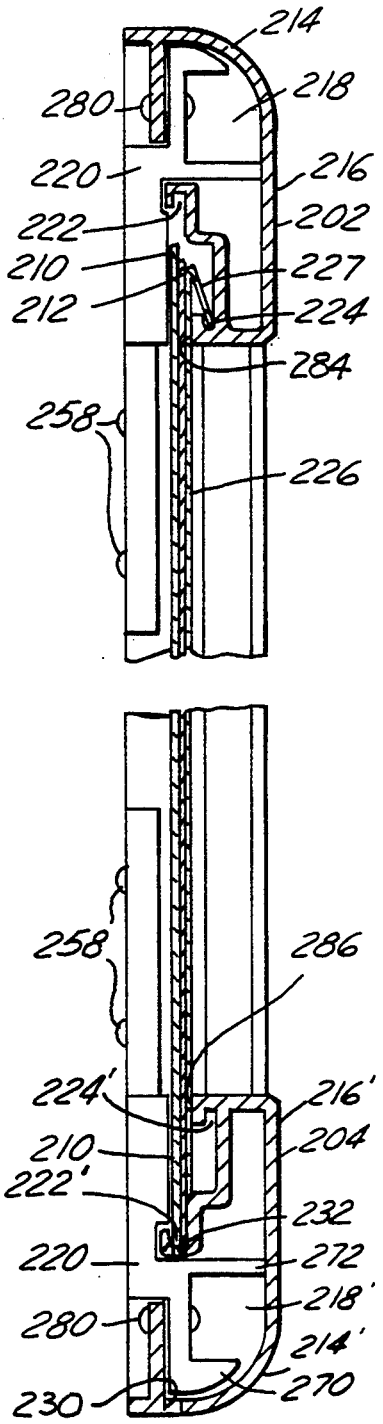
FIG. 13 is a cross-sectional view of the wall mounted poster and sign display as shown in FIG. 9 taken along line 11—11 and in the direction of the arrows.

As shown in FIGS. 11–13, the wall mounted sign device comprises upper and lower frame members 202 and 204, side frame members 206 and 208, and a backing member 210. The four frame sections 202, 204, 206 and 208 surround the perimeter of the backing member 210 to form a rectangular frame or sign device for holding and retaining sign materials and display indicia 212 for presentation to customers and passersby.

Figure 14:
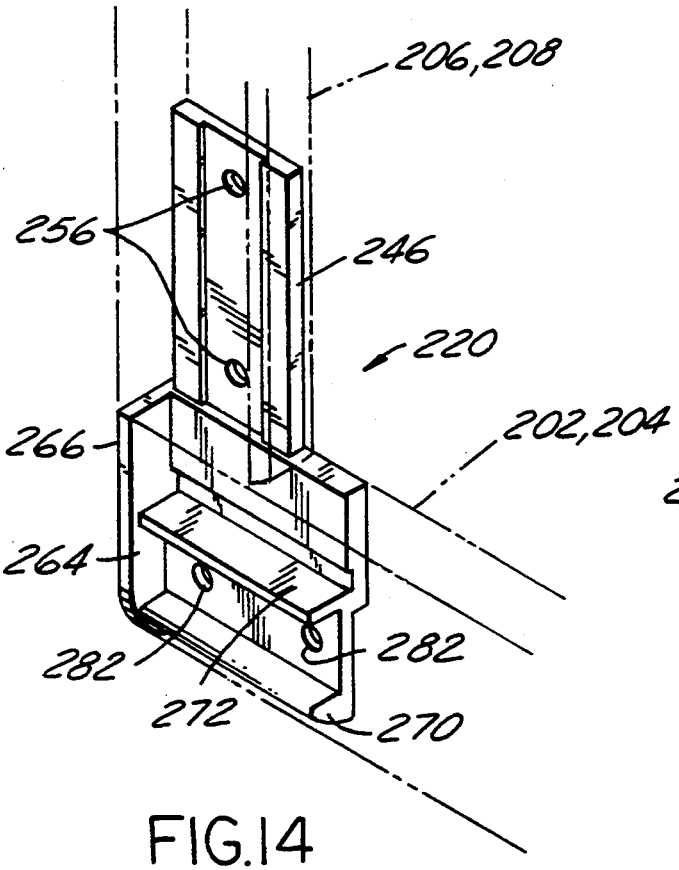
FIG. 14 illustrates the corner connecting member used with the wall mounted poster and sign display.

The upper and lower frame members 202 and 204, respectively, have the same cross-sectional size and shape and are preferably made from an extruded metal material, such as aluminum. The frame members 202 and 204 have curved surfaces 214 and 214', outer wall surfaces 216 and 216' and open interior cavities 218 and 218' which are used for interconnection with the corner connecting members 220, as shown in FIGS. 13 and 14.

The upper and lower frame members 202 and 204 each have a first channel 222 and 222' which is used to hold and retain the backing member 212, and each have a second channel member 224 and 224' which is used to hold and retain the clear protective covering member 226 (at least in the upper frame member 202).

Figure 15:
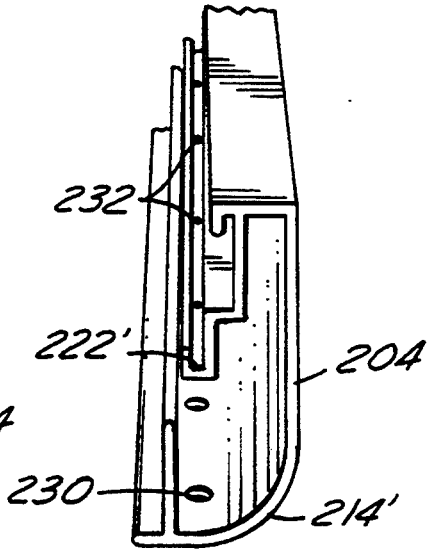
FIG. 15 is a perspective view of the lower curved extrusion member showing the moisture drainage holes.

The lower frame member 204 contains a plurality of holes 230 in the curved section 214 in order to drain out water and moisture which may have been trapped inside the member 204. Also, channel 222' contains a plurality of holes 232 along its length in order to eliminate any water or moisture which might be present in the channel after running down the face of the sign indicia or covering member 226. The drainage holes are shown in FIGS. 13 and 15.

The side frame members 206 and 208 are identical. For illustration and descriptive purposes, only frame member 206 will be explained in detail, but it is understood that the description applies equally to frame member 208 as well.

Side frame members 206, 208 include a base member 240 and a cover member 242, as best shown in FIG. 12. The base member and cover member are elongated extrusion members, preferably made of a metal material, such as aluminum.

The base member 240 has elongated channel 244 which is sized and dimensioned to fit the insert portion 246 of the corner connecting member 220. The base member 240 also has a hinge formation 248 which is used to connect with the cover member 242 to form a pivoting hinged relationship.

The base member 240 also includes a second channel 250 which is used to hold the side edges of the backing member 210 (See FIG. 12).

The cover member 242 includes a mating hinge formation 252 which cooperates with hinge formation 248 on the base member 240 to form a pivoting hinge. A metal leaf spring 254 is positioned between the cover member 242 and the base member 240 and acts to bias the cover member in its open and closed position for insertion and retention of display indicia 212 in the sign device 200. In this regard, the operation of the spring biased cover member and the side frame members is the same as that described above with reference to the side frame extrusion members 34 and U.S. Pat. No. 4,145,828, the disclosure of which is hereby incorporated by reference.

Four corner connecting members 220 are provided in the wall mounted display 200. One of the corner connecting members is provided on each of the four corners of the sign display 200 and are used to interconnect together the four frame members 202, 204, 206 and 208.

As shown in FIGS. 13–14, the corner connecting members 220 have an insert section 246 which is sized and dimensioned to slidingly fit within channel 244 in the base member 240 of the side extrusion members 206. Holes or openings 256 are provided in the insert section 246 in order to allow the corner connecting member 220 to be securely attached to the side frame member by conventional fasteners, such as pop rivets 258, when the two members are assembled together. In this regard, recess 260 is provided in the base member 240 of the side frame section members 206 in order to provide space for the one end of the pop rivet 258. This prevents the fasteners or rivets 258 from contacting and interfering with the placement of the backing member 210 and display indicia 212 in the sign device 200.

The corner connecting member also includes an end capped portion 264 which is connected to the insert portion 246. The end cap portion 264 fits within the open ends of the upper and lower frame extrusions 202 and 204. The cap sections have an external cover member 266 which fits flush against the outer ends of the extrusions 202 and 204 to form a complete and aesthetically pleasing frame 200. The cap portion 262 also includes a curved section 270 and an outwardly extending flange 272. The curved portion 270 is configured in size to mate with the interior surface of the curved surface 214 and 214' of the upper and lower extrusion members 202 and 204, respectively. The flange 272 is sized and shaped to abut the inside surfaces of the wall members 216 and 216'. As is apparent from FIGS. 13 and 14, the cap member 220 and the upper and lower frame members 202, 204 are sized and dimensioned to allow a sliding fit together when they are assembled. The corner connecting members 220 are secured to the upper and lower frame extrusions 202, 204 by means of conventional fasteners such as pop rivets 280 which are positioned through holes 282 in the corner connecting members 220.

The corner connecting members 220 are formed of any sturdy and durable material, such as metal or hard plastic. Preferably, the corner connecting members 220 are formed of glass-filled nylon or polycarbonate. It is also possible to provide the corner connecting members of a die cast metal material, such as aluminum or zinc.

Similar to the free standing sign display 20 described above with reference to FIGS. 1–10, a clear protective covering member is also provided on the wall mounted sign display 200. As shown in FIG. 13, the covering member 226, which preferably is of a clear plastic material, has an acutely bent upper portion 227 which is positioned in the upper frame member 202. The upper portion of the covering member 226 is acutely bent more than 90° as shown in FIG. 13 so that when the covering member is inserted into the slot 284 formed between the corner connecting member 220 and frame member 202 will be secured in channel 224.

The lower end of the covering member 226 simply rests within the corresponding slot 286 in the lower edge of the sign device 200. The benefits and advantages achieved by use of the plastic covering member and by only clamping it on two side edges are the same as those described above with reference to the free standing sign stand assembly.

When the wall mounted sign display 200 is assembled, corner connecting members 220 are inserted into the ends of the frame extrusions 202 and 204 and secured by fasteners or rivets 280. The corner connecting members 220 are then inserted into the side members 206, 208 and secured thereto by fasteners or rivets 258. Prior to placing the four frame members together, the backing member 210 is positioned in the center of the four members and the four members are formed around the perimeter of the backing member 210. In this manner, the backing member 210 is held securely in place in the sign device 200 and separate fasteners or fastening members are not needed.

As is evident from the above description, the wall mounted sign device can be positioned on any type of wall or surface, and used either indoors or outdoors. One of the advantages of the present invention is that the device 200 can be used outdoors and not be adversely affected by rain, snow and other environmental conditions.

In order to insert or remove display indicia 212 from the sign device 200, the cover members 242 are rotated to their open position and the clear plastic covering material 226 is raised up or rotated out of the way. The display indicia 212 is then inserted against the backing member and the top edge is slid upwardly into slot 284 until the bottom edge clears the lower frame extrusion 204 and then "falls" into slot 286. The covering member 226 is then repositioned over the face of the sign material 222 and the cover members 242 are closed along the two edges of the device 200 securely holding and retaining the display indicia and covering material 226 firmly in place.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. A sign display for displaying sign indicia comprising:

a backing member for said sign indicia;

an upper frame member having a curved outer surface and a channel for insertion of an edge of said backing member;

a lower frame member having a curved outer surface and a channel for insertion of a second edge of said backing member;

a pair of side frame members each having a biased clamping member and a channel for insertion of an additional edge of said backing member;

corner members connecting together said upper frame member to said side frame members and connecting together said lower frame member to said side frame members;

clear protective member positioned adjacent said backing member and secured in said channel in said upper frame member;

said upper frame member having a projection member adjacent said channel and said protective member has a bent edge which is secured in place by said projection member; and said channel in said lower frame member having means for limiting the extent of entry of said backing member, sign indicia and protective member into said lower frame member.

2. The sign display as set forth in claim 1 further comprising a base assembly for holding said sign display in a generally vertical orientation.

3. The sign display as set forth in claim 2 wherein said base assembly comprises at least one ground engaging member and at least one biasing member for allowing said sign display to deflect in strong wind conditions and returning said sign display to its normal upright condition upon cessation of said wind conditions.

4. The sign display as set forth in claim 3 wherein said ground engaging members are secured vertically underneath said biasing member.

5. The sign display as set forth in claim 1 wherein said backing member is held in place by said four frame members without fasteners.

6. The sign display as set forth in claim 1 wherein said corner member has cap portions which cover the open ends of said upper and lower frame members.

7. The sign display as set forth in claim 1 wherein sign indicia are displayed on both sides of said sign display and backing member.

8. A sign display for displaying sign indicia members comprising:

a backing member;

an upper frame member having an integral outer surface and an open channel for insertion of an edge of said backing member and loose insertion of an upper edge of said sign indicia member;

a lower frame member having a curved outer surface and an open channel for insertion of a second edge of said backing and loose insertion of a lower edge of said sign indicia member;

a pair of side frame members each having a biased clamping member and a channel for insertion of an additional edge of said backing member;

said clamping members securely holding in place both side edges of said sign indicia member;

transparent sheet member for covering and protecting said sign indicia member, whereby said sign indicia members are only loosely inserted in said open channels in said upper and lower frame members and only securely clamped and held in place along the side edges by said clamping members.

9. The sign display as set forth in claim 8 further comprising a base assembly for holding said sign display in a generally vertical orientation.

10. A method for positioning and holding a sign member in a display, said display having an upper frame member, a lower frame member, and two side frame members, said side frame members having biased clamping members, said method comprising the steps of:

loosely inserting said sign member in said upper frame member;

loosely inserting said sign member in said lower frame member;

positioning said sign members in said side frame members;

holding said sign members in place with said biased clamping members;

covering said sign member with a transparent protective sheet member;

wherein said sign member is held in place in said display only by said biased clamping members on said side members.

11. A two-sided sign display device for holding and displaying sign members on each side thereof, said device comprising:

a backing member;

an upper frame member having an integral upper surface to protect said sign members from the elements and a first open channel in its lower surface, the upper edges of said sign members being loosely positioned in said first open channel;

a lower frame member having a second open channel in its upper surface, the lower edges of said sign members being loosely positioned in said second open channel;

said lower frame member having means for limiting the extent of entry of said sign members in said second open channel in order to prevent said sign members from contacting the bottom of said lower frame member;

said backing member having its upper edge loosely positioned in said first open channel and having its lower edge loosely positioned in said second open channel;

side frame means on each side of said backing member;

each side frame means comprising a pair of clamping members;

said backing member supporting said sign members on each side of said display device;

said clamping members securely holding said sign members in position in said display device; and transparent sheet means positioned on each side of said display device for protecting said sign members;

wherein said sign members are secured in place in said sign display device only by said clamping members on said side frame members.

12. A sign display device for holding and displaying indicia members, said display device comprising:

an upper frame member having an elongated continuously curved integral upper surface, two ends, and a first open channel in its lower surface;

two elongated side frame members, each side frame member having an upper end and a lower end and a second open channel along its length;

upper cap members;

said upper cap members each having a first portion positioned in an end of one of said upper frame members, a second portion positioned in the upper end of one of said side frame members , and a third exterior portion comprising part of the display device;

a lower frame member having an elongated continuously curved lower surface, two ends, and a third open channel in its upper surface;

lower cap members, said lower cap members having a first portion positioned in an end of one of said lower frame members, a second portion positioned in the lower end of one of said side frame members, and a third exterior portion comprising part of the display device, said first portion having stop means for limiting the extent of entry of said indicia members into said third open channel;

said upper and lower frame members having substantially the same cross-sectional shape; and clamping members rotatably attached to each of said side frame members for securing holding said display indicia in said display device;

whereby said indicia members are only loosely positioned in said first and third open channels and are secured in said display device only by said clamping members on said side frame members.

13. The sign display device as set forth in claim 12 further comprising transparent sheet means positioned in said first and third open channels and held in place by said clamping members for protecting said indicia members.

* * * * *